US009475595B2

(12) United States Patent
Paradisi et al.

(10) Patent No.: US 9,475,595 B2
(45) Date of Patent: Oct. 25, 2016

(54) FOLDING UNIT FOR FORMING SEALED PACKAGES OF POURABLE FOOD PRODUCTS

(75) Inventors: Stefano Paradisi, Carpi (IT); Matteo Galloni, Nonantola (IT); Roberto De Pietri Tonelli, Formigine (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 683 days.

(21) Appl. No.: 13/883,106

(22) PCT Filed: Dec. 16, 2011

(86) PCT No.: PCT/EP2011/073076

§ 371 (c)(1),
(2), (4) Date: May 2, 2013

(87) PCT Pub. No.: WO2012/084719

PCT Pub. Date: Jun. 28, 2012

(65) Prior Publication Data

US 2013/0237396 A1 Sep. 12, 2013

(30) Foreign Application Priority Data

Dec. 21, 2010 (EP) ..... 10196342

(51) Int. Cl.
*B65B 1/02* (2006.01)
*B65B 61/24* (2006.01)
(Continued)

(52) U.S. Cl.
CPC ..... *B65B 1/02* (2013.01); *B65B 61/24* (2013.01); *B65B 9/20* (2013.01); *B65B 35/26* (2013.01)

(58) Field of Classification Search
CPC ..... B65B 1/24; B65B 1/02; B65B 9/20
USPC ..... 493/243, 175, 180, 183, 189, 197, 202, 493/241, 250, 252
See application file for complete search history.

(56) References Cited

U.S. PATENT DOCUMENTS 3,999,469 A 12/1976 Nilsson
5,120,292 A * 6/1992 Ueda ..... B31B 1/32 493/124

(Continued)

FOREIGN PATENT DOCUMENTS

CN 1178753 A 4/1998
CN 1318494 A 10/2001

(Continued)

OTHER PUBLICATIONS

Office Action issued on May 22, 2014, by the Chinese Patent Office in corresponding Chinese Patent Application No. 201180062080.8 and an English translation of the Office Action. (15 pages).

(Continued)

*Primary Examiner* — Hemant M Desai
*Assistant Examiner* — Valentin Neacsu
(74) *Attorney, Agent, or Firm* — Buchanan Ingersoll & Rooney PC

(57) ABSTRACT

There is described a folding unit for forming sealed packages of pourable food products, comprising: at least one conveying device for feeding along a forming path a relative pack which have at least one portion to be folded to form a finished package; at least one folding device interacting, in use, with pack along said forming path and adapted to fold said at least one portion; conveying device comprises a first and a second surface opposite to another and adapted, in use, to cooperate respectively with a front and a rear wall opposite to each other of relative pack to be folded; first surface is at least partially concave.

8 Claims, 6 Drawing Sheets

(51) Int. Cl.
*B65B 35/26* (2006.01)
*B65B 9/20* (2012.01)

(56) References Cited

U.S. PATENT DOCUMENTS

| | | | | |
|---|---|---|---|---|
| 5,943,840 | A * | 8/1999 | Nilsson | B31B 1/84 493/105 |
| 6,149,566 | A * | 11/2000 | Nishio | B29B 13/025 493/133 |
| 6,599,225 | B2 * | 7/2003 | Ammons | B31B 1/62 493/183 |
| 2001/0029721 | A1 | 10/2001 | Sato et al. | |
| 2009/0005227 | A1 * | 1/2009 | Rimondi | B65B 49/08 493/184 |
| 2012/0279182 | A1 | 11/2012 | Barbieri et al. | |

FOREIGN PATENT DOCUMENTS

| | | | | |
|---|---|---|---|---|
| CN | 101652288 | A | 2/2010 | |
| CN | 201472732 | U | 5/2010 | |
| EP | 0061663 | A2 | 10/1982 | |
| EP | 0 819 609 | A1 | 1/1998 | |
| EP | 1145961 | A1 | 10/2001 | |
| EP | 2392517 | A1 | 12/2011 | |
| JP | S6355038 | A | 3/1988 | |
| JP | 02-258515 | A | 10/1990 | |
| JP | EP 0819609 | A1 * | 1/1998 | B65B 59/005 |
| JP | 10-29610 | A | 2/1998 | |
| JP | 10-86904 | A | 4/1998 | |
| SU | 574140 | A3 | 9/1977 | |
| WO | WO 2008/122623 | A2 | 10/2008 | |

OTHER PUBLICATIONS

International Search Report (PCT/ISA/210) Issued on Jun. 8, 2012, by the European Patent Office as the International Searching Authority for International Application No. PCT/EP2011/073076.

Written Opinion (PCT/ISA/237) issued on Jun. 8, 2012, by the European Patent Office as the International Searching Authority for International Application No. PCT/EP2011/073076.

Japanese Official Action issued Feb. 1, 2016, by the Japan Patent Office, in corresponding Japanese Patent Application No. 2013-545221, with English-language translation of Official Action (7 pages).

The extended European Search Report issued on Nov. 8, 2011, by the European Patent Office in corresponding European Application No. 10196342.9. (9 pages).

Office Action (Decision of Granting) issued on Nov. 5, 2015, by the Russian Patent Office in corresponding Russian Patent Application No. 2013133851, and an English Translation of the Office Action. (12 pages).

* cited by examiner

FOLDING UNIT FOR FORMING SEALED PACKAGES OF POURABLE FOOD PRODUCTS

TECHNICAL FIELD

The present invention relates to a folding unit for forming sealed packages of pourable food product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by creasing and sealing laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminium foil, which is superimposed on a layer of heat-seal plastic material, and is in turn covered with another layer of heat-seal plastic material forming the inner face of the package eventually contacting the food product.

Packages of this sort are normally produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; the web so sterilized is then maintained in a closed, sterile environment, and is folded and sealed longitudinally to form a tube, which is fed vertically.

In order to complete the forming operations, the tube is filled with the sterilized or sterile-processed food product, and is sealed and subsequently cut along equally spaced cross sections.

More precisely, the tube is sealed longitudinally and transversally to its own axis.

Pillow packs are so obtained, which have a longitudinal seal and a pair of top and bottom transversal seals.

Alternatively, the packaging material may be cut into blanks, which are formed into packages on forming spindles, and the packages are then filled with the food product and sealed. One example of this type of package is the so-called "gable-top" package known by the trade name Tetra Rex (registered trademark).

More specifically, the pillow packs comprise a parallelepiped-shaped main portion; and opposite, respectively top and bottom, end portions tapering from the main portion to respective sealing lines crosswise to the pack. Each end portion has substantially triangular flaps projecting from opposite sides of the main portion; and a low rectangular tab projecting from the relative sealing line.

Packaging machines of the above type are known, on which the pillow packs are turned into folded packages by automatic folding units.

Folding units are known, for example from the International Application No WO2008122623 in the name of the same Applicant, which substantially comprise:

- a rotary conveyor which receives pillow packs to be folded at inlet station, conveys pillow packs to be folded along an arc-shaped folding path, and outputs folded packages at an output station;
- a first folding unit which interacts with a bottom portion of the pack travelling along the folding path to perform a folding operation onto the packs;
- a heating device for heating the flaps of the packs travelling along the folding path; and
- a second folding device for pressing flaps of each pack travelling along forming path onto respective wall, as flaps cool.

In greater detail, rotary conveyor comprises a plurality of angular-spaced conveying devices, which grip packs at inlet station, and feed them along a forming path to output station.

Each conveying device comprises two flat surfaces which face each other and cooperate, in use, respectively with a front and a rear wall of the main portion of the relative pack to be folded.

A need is felt within the industry for the maximum flexibility as regards the final shape of packages folded by the folding machine.

This is particularly so in the case of newly conceived packages which have a front wall bulging on the opposite side of a rear wall.

DISCLOSURE OF INVENTION

It is an object of the present invention to provide a folding unit for producing sealed packages of pourable food products, and designed to provide the above aim in a straightforward, low-cost manner.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
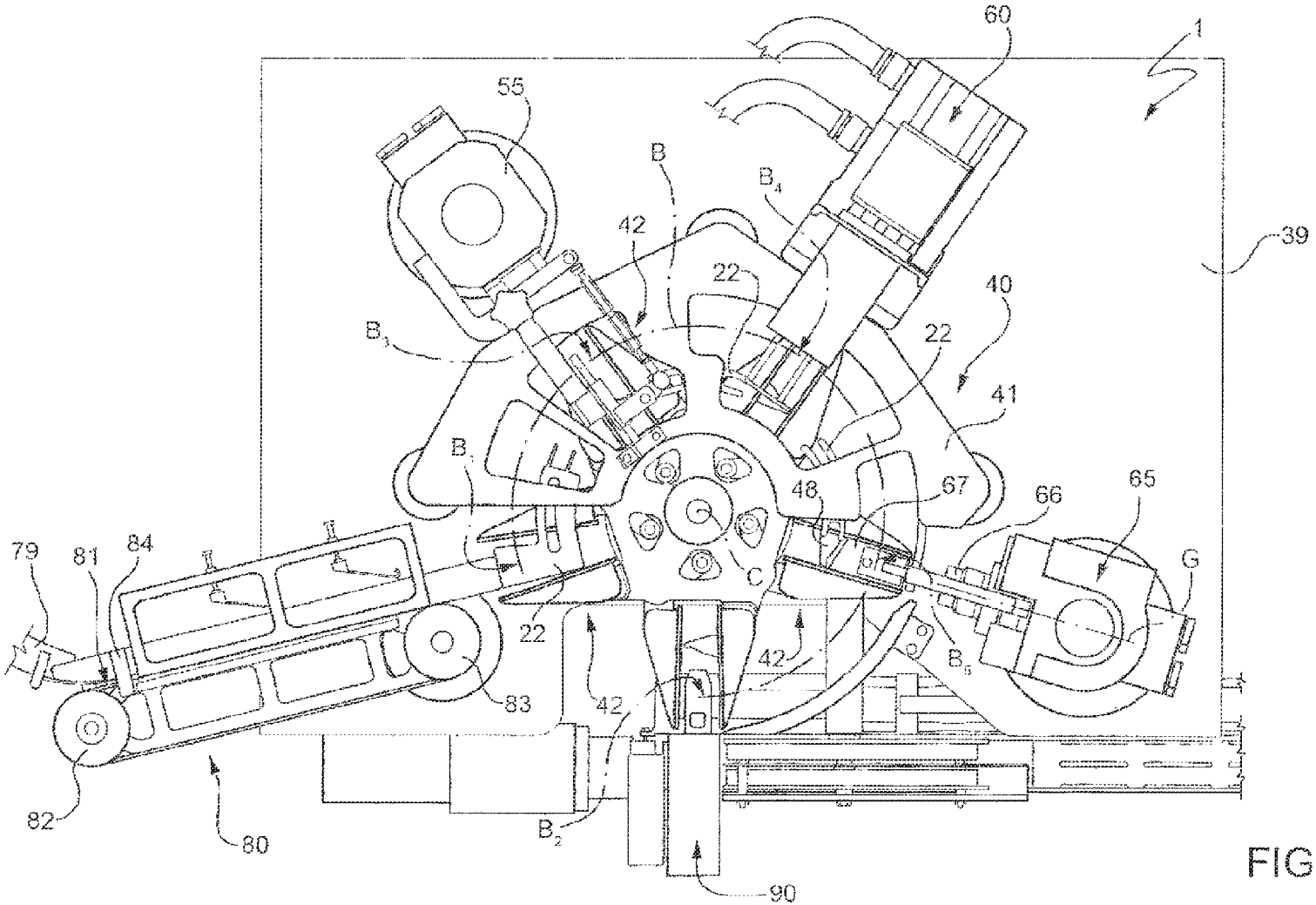
FIG. 1 is a front view of a folding unit, for pourable food product packaging machines, in accordance with the present invention.

Number 1 in FIG. 1 indicates as a whole a folding unit for a packaging machine for continuously producing sealed, parallelepiped-shaped packages 2 (FIG. 6) of a pourable food product, such as pasteurized or UHT milk, fruit juice, wine, etc., from a known tube, not shown, of packaging material.

More specifically, the tube is formed in a known manner upstream from folding unit 1 by longitudinally folding and sealing a web of heat-seal sheet material, and is filled with the sterilized or sterile-processed food product.

The tube of packaging material is then sealed and cut along equally spaced cross sections to form a number of pillow packs 3 (FIG. 5), which are then sent to unit 1 where they are folded mechanically into respective packages 2.

Figure 5:
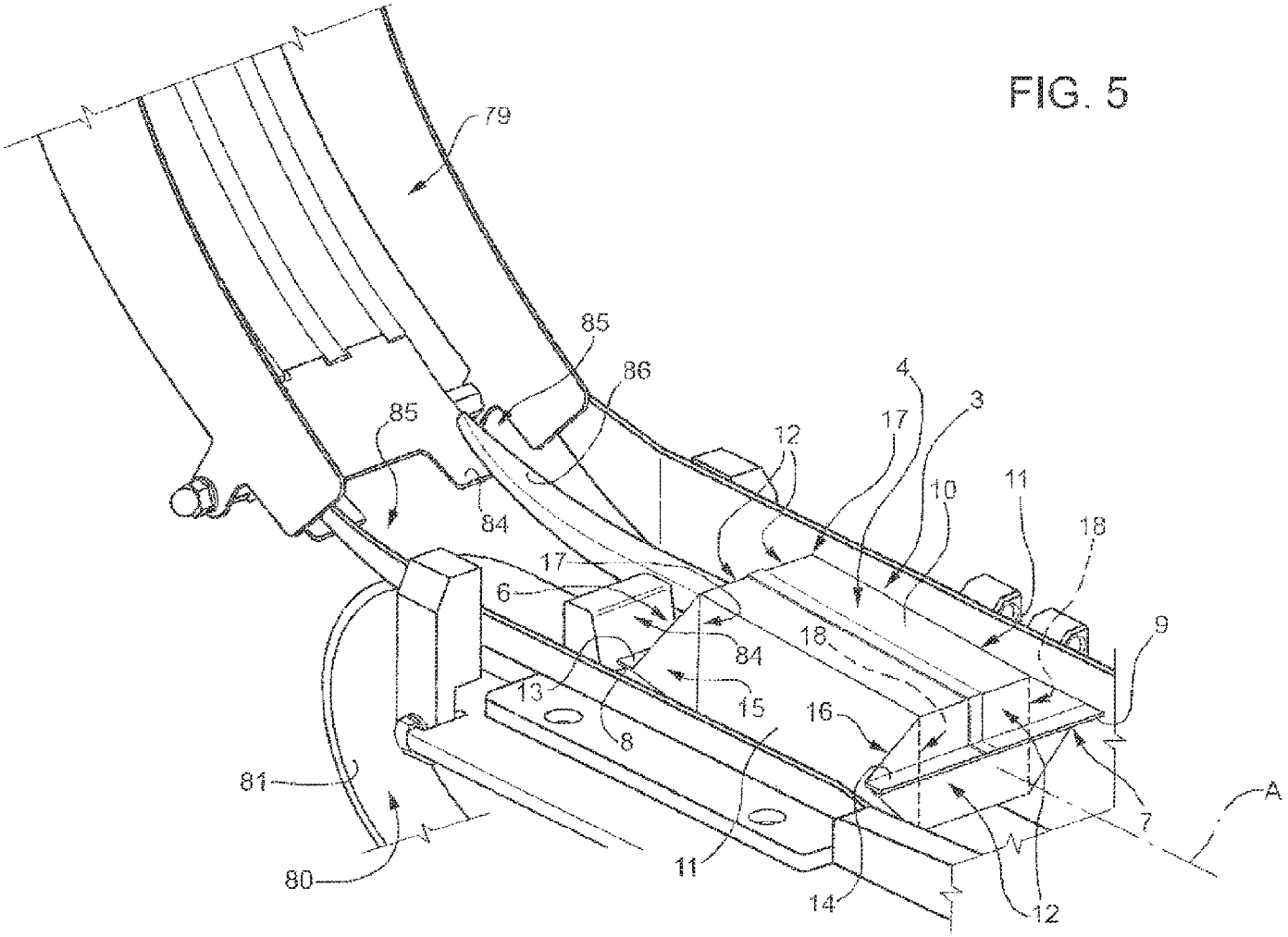
FIG. 5 is an enlarged perspective view of a third assembly of the folding unit of FIG. 1.

With reference to FIG. 5, each pack 3 has an axis A, and comprises a parallelepiped-shaped main portion 4; and opposite, respectively top and bottom, end portions 6, 7 tapering from portion 4 to respective sealing lines 8, 9, crosswise to axis A, of pack 3.

More specifically, portion 4 of each pack 3 is bounded laterally by two rectangular walls 10, that are opposite to each other, on either side of axis A; and by two concave walls 11 extending between walls 10.

In detail, a first wall 10 intended to form front wall 102 of folded package 2 is convex and a second wall 10 intended to form rear wall 103 of folded package 2 is flat.

Each portion 6, 7 is defined by two walls 12 substantially in the form of an isosceles trapezium, sloping slightly towards each other with respect to a plane perpendicular to axis A, and having minor edges defined by respective end edges of walls 10 of portion 4, and major edges joined to each other by the respective sealing line 8, 9.

For each portion 6, 7, each pack 3 has an elongated, substantially rectangular tab 13, 14 projecting from respective sealing line 8, 9; and two substantially triangular flaps 15, 16 projecting laterally from opposite sides of portion 4 and defined by end portions of relative walls 12.

Figure 6:
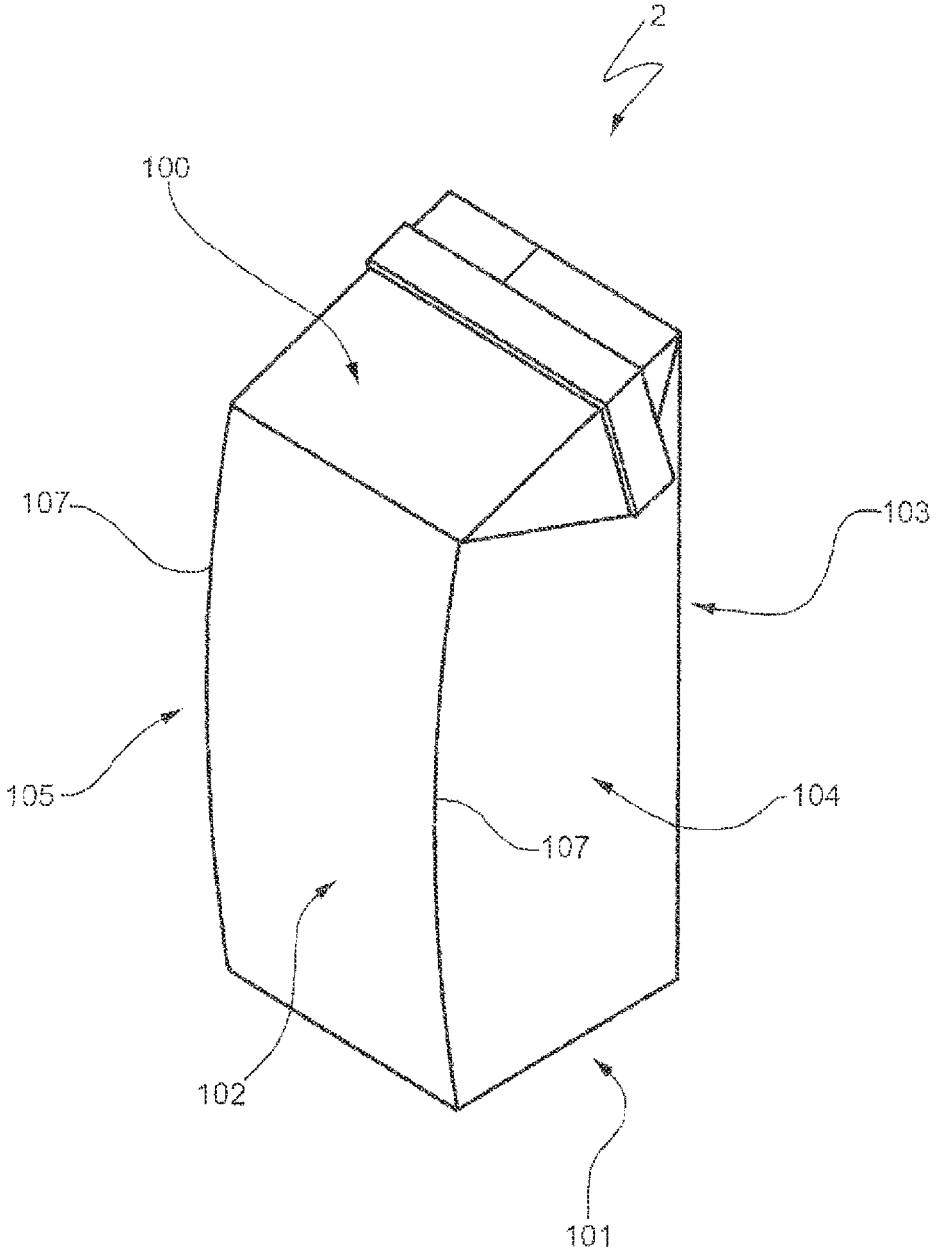
FIG. 6 is a perspective enlarged view of a package folded by the folding unit of FIG. 1.

With reference to FIG. 6, package 2 has a top panel of the type disclosed in the European Application no. 10165116, which is hereby incorporated by reference.

Very briefly, package 2 comprises:

- a slanted top wall 100;
- a bottom wall 101;
- a convex front and a flat rear wall 102, 103 which extend between walls 100, 101; and
- a pair of concave lateral walls 104, 105 which extends between walls 100, 101 and between walls 102, 103.

Furthermore, convex front wall 102 is laterally bounded by to curved crease lines 107 which are opposite to each other and extend between walls 100, 101.

To form a package 2, unit 1 presses portions 6, 7 of pack 3 towards each other, while at the same time folding respective tabs 13, 14 onto portions 6, 7; folds and seals flaps 15 of portion 6 onto relative walls 12; and folds and seals flaps 16 of portion 7 onto respective walls 11 of portion 4.

More specifically, flaps 15, 16 are folded with respect to walls 12, 11 about respective fold lines 17, 18 coincident with respective edges between walls 11 and portions 6, 7.

Unit 1 substantially comprises (FIG. 1):

- a main conveyor 40 rotatable about an axis C and which feeds a succession of packs 3 in steps along an arc-shaped forming path B;
- a folding device 55 fitted to a fixed structure 39 of unit 1 have an interacting surface movable back and forth radially to axis C so as to interact with portions 6 of packs 3 travelling along path B to perform a folding operation on the packs;
- a heating device 60 fitted to structure 39 of unit 1 and which heats the unfolded flaps 15, 16 of each pack 3 travelling along path B preparatory to heat sealing them onto respective walls 11, 12; and
- an additional folding device 65 fitted to structure 39 of unit 1 and having a pressure device 66 and a pair of pressure devices 67 for pressing flaps 15, 16, respectively of each pack 3 travelling along path B onto respective walls 12, 11 as flaps 15, 16 cool.

Furthermore, unit 1 also comprises a number of pairs of rails 22 fitted to the structure 39 of unit 1. Rails 22 of each pair extend along path B on respective axial opposite sides of conveyor 40, and cooperate with packs 3 along path B to perform a number of folding operations thereon.

In detail, path B extends from a loading station $B_1$, where conveyor 40 receives each pack 3 from an input conveyor 80, to an unloading station $B_2$, where conveyor 40 unloads a relative package 2 (FIG. 4) onto an output conveyor 90.

From station $B_1$ towards station $B_2$, path B also comprises:

- a first portion, along which a first pair of rails 22 interact with each pack 3 to guide it along path B; and
- a station $B_3$ where the interacting surface of folding device 55 interacts with each pack 3 to convert it from a pillow configuration shown in FIG. 5 to a configuration in which portions 6, 7 are pressed towards each other to fold walls 12 of portions 6 into a position perpendicular to axis A and to fold walls 12 of portion 7 into a position slanted relative to axis A; folding device 55 further folds tabs 13, 14 onto respective walls 12, flaps 15 about fold lines 17 into a position parallel to axis A, and flaps 16 about fold lines 18 into a position sloping slightly towards portion 6 relative to the folded wall 12 of portion 7; and
- a second portion, along which a second pair of rails 22 interact with each pack 3 to convert it to a configuration in which flaps 15, 16 slope forty-five degrees with respect to relative walls 12, 11, and extend from respective fold lines 17, 18 towards axis A and away from axis A respectively.

From the second portion to station $B_2$, path B also comprises:

- a station $B_4$ where heating device 60 heats flaps 15, 16 of each pack 3, preparatory to heat sealing them onto respective walls 12, 11;
- a third portion, along which the third pair of rails 22 fold flaps 15, 16 of each pack 3 to convert it to a configuration, in which flaps 15, 16 slope roughly ten degrees with respect to walls 12, 11, and extend from fold lines 17, 18 respectively towards axis A and away from axis A;
- a station $B_5$ where pressure devices 66 and 67 of folding device 65 fold respective flaps 15, 16 of each pack 3 onto relative walls 12, 11 to complete formation of package 2 (FIG. 4); and
- a fourth portion terminating at station $B_2$, and along which a fourth pair of rails 22 keep flaps 16 pressed onto walls 11 to prevent accidental detachment of the flaps as they cool.

Conveyor 80 (FIG. 1) comprises an endless belt looped about a not-shown drive pulley and a return pulley 82, 83; and a number of push members 84 (only one of which is shown in FIG. 5) fitted given distances apart to belt 81, and which interact with portions 6 of respective packs 3 to move the packs from an upstream chute 79 to conveyor 40.

More specifically, push members 84 are equally spaced along belt 81, and travel, in use, along an endless path of the same shape as belt 81.

On conveyor 80, each pack 3 is positioned with a first wall 10 facing conveyor 80, with a second wall 10 facing away from conveyor 80 and with portion 6 resting against relative push member 84.

Conveyor 80 also comprises a pair of stationary rails 85 which are arranged at opposite lateral sides of belt 81. Rails 85 have relative portion 86 which are sloped relative to belt 81 and cooperate with respective portions of tabs 13, 14 that rest on portion 86 of rail 85, so as to protect the first wall 10.

Conveyor 40 comprises a hub 41 rotating about axis C; and a number of—in the example shown, five—conveying devices 42 for gripping respective packs 3 at station $B_1$ of path B, and feeding them along path B to station $B_2$, so packs 3 interact with rails 22, folding devices 55, 65, and heating device 60.

Figure 2:
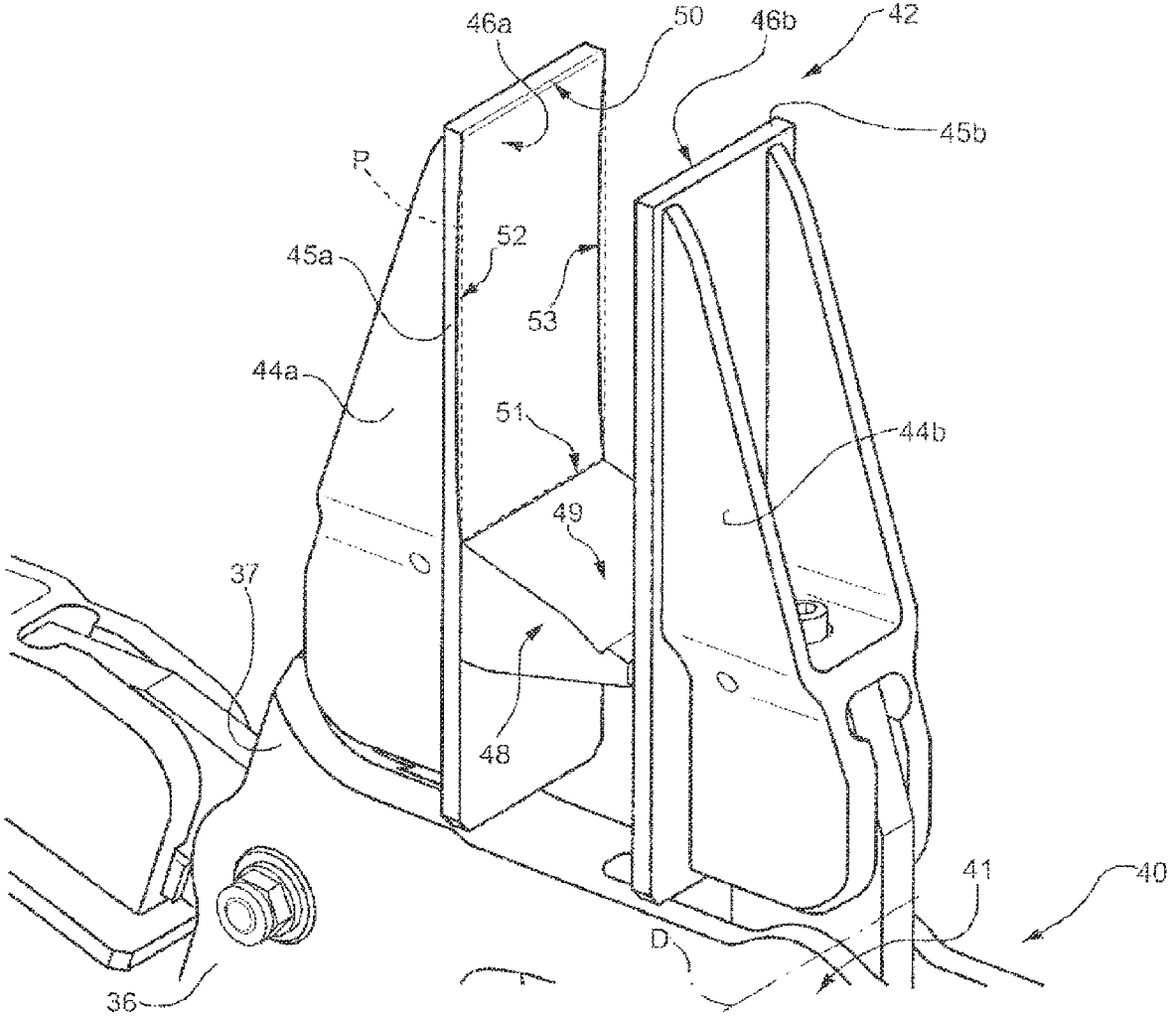
FIG. 2 is an enlarged perspective view of a first assembly of the folding unit of FIG. 1, in a first angular position.

Hub 41 comprises a main body 36 and a plurality of pairs of arms 37 which radially protrude from the outer periphery of main body 36 (FIG. 2).

More specifically, hub 41 is rotated in steps about axis C by a motor not shown.

Conveying devices 42 are equally spaced angularly about axis C; and project from hub 41, on the opposite side to axis C and along respective radial directions relative to axis C.

Conveying devices 42 are therefore angularly integral with hub 41.

Each conveying device 42 comprises (FIGS. 2 to 4):

- a pair of supports 44*a*, 44*b* radially projecting from respective arm 37; and
- a pair of members 45*a*, 45*b* fixed to relative supports 44*a*, 44*b* and facing each other.

Support 44*b* of each conveying device 42 is hinged to respective arm 37 about an axis D parallel to axis C.

Support 44*a* of each conveying device 42 is fixed to respective arm 37.

Members 45*a*, 45*b* of each conveying device 42 comprise relative surfaces 46*a*, 46*b* which are elongated radially with respect to axis C and face each other.

Surfaces 46*a*, 46*b* cooperate with respective first and second walls 10 of relative pack 3, so as to hold pack 3 along path B.

In detail, surface 46*a* cooperates with first wall 10 of pack 3 intended to form front wall 102 of folded package 2 and surface 46*b* cooperates with second wall 10 of pack 3 intended to form rear wall 103 of folded package 2.

Advantageously, surface 46*a* is concave.

In detail, surface 46*a* is bounded by a rectilinear radial outer edge 50 and a radial inner edge 51 which are opposite to each other, and by a pair of edges 52, 53 which are opposite to each other and extend between edge 50, 51.

Edges 50, 51 define a theoretical plane P which is radial to axis C and edges 52, 53 extend on the opposite side of plane P relative to surface 46*b*.

In particular, edges 52, 53 extend at first at increasing distances and then at decreasing distances from plane P, proceeding radially to axis C from edge 50 to edge 51.

Figure 4:
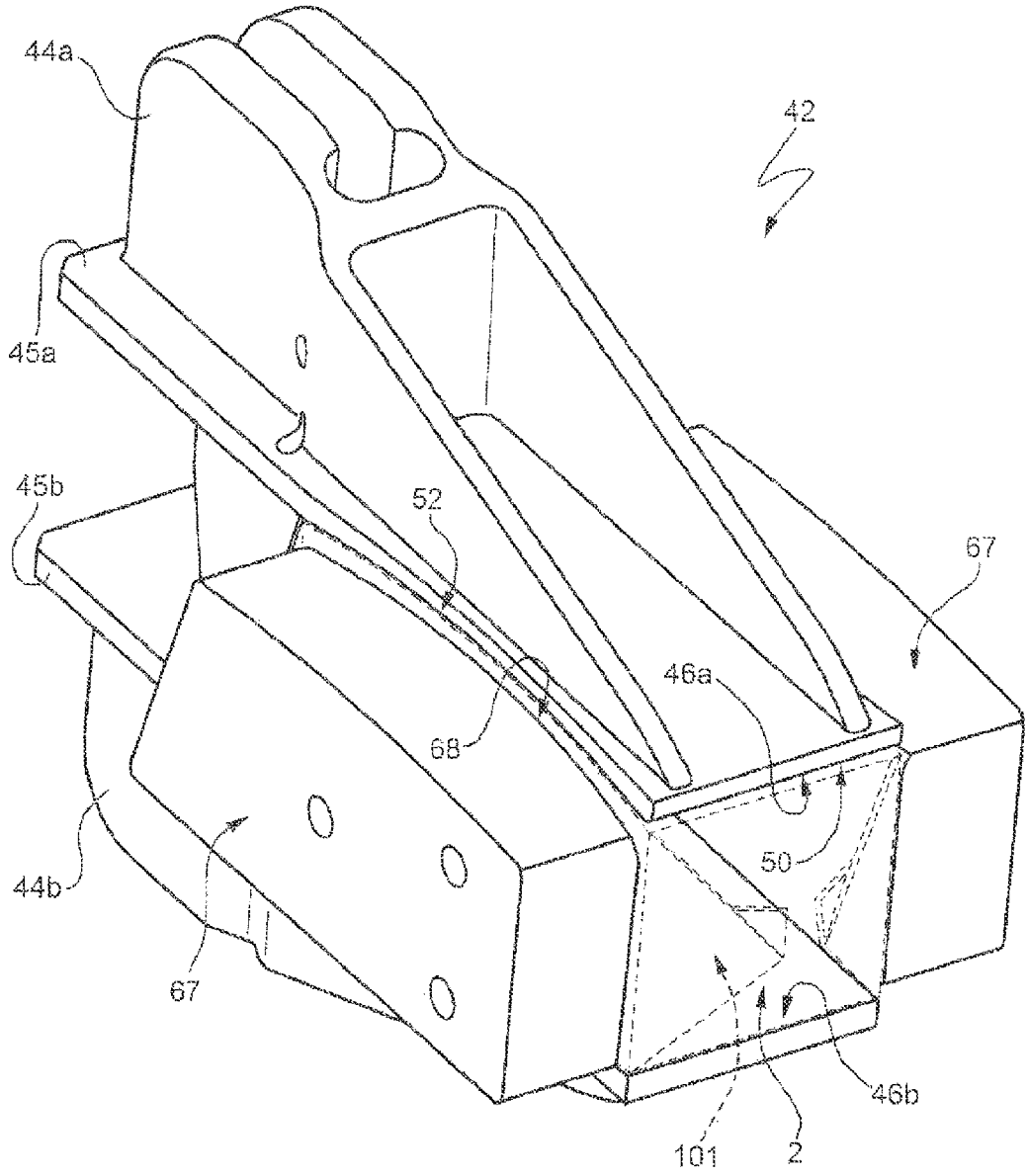
FIG. 4 is a perspective view taken under a different visual angle of the first assembly and second assembly of FIG. 3.

Furthermore, edges 52, 53 converge to each other and then diverge from each other, proceeding radially to axis C from edge 50 to edge 51, as shown in FIG. 4.

Surface 46*b* is, in the embodiment shown, planar.

Each conveying device 42 further comprises a slanted element 48 projecting from edge 51 of surface 46*a* of member 45*a* towards surface 46*b* and extending transversally to surface 46*b*.

Each element 48 comprises a surface 49 which is slanted relative to surface 46*a*. Surface 49 cooperates with portion 7 of each pack 3 which is moved along path B by relative conveying device 42.

With reference to FIGS. 1 to 4, pressure device 66 of folding device 65 is movable back and forth along an axis G radial to axis C between a work position, in which it presses flaps 15 of each pack 3 onto walls 12 of portion 6 of pack 3, and a rest position, in which it is detached from flaps 15.

Pressure devices 67 are movable back and forth between a work position, in which relative surfaces 68 press respective flaps 16 of each pack 3 onto respective walls 11, and a rest position, in which they are detached from flaps 16 to permit travel of pack 3 along path B (FIG. 6).

The movement of pressure device 67 is synchronized in a not shown manner with the movement of pressure device 66.

Figure 3:
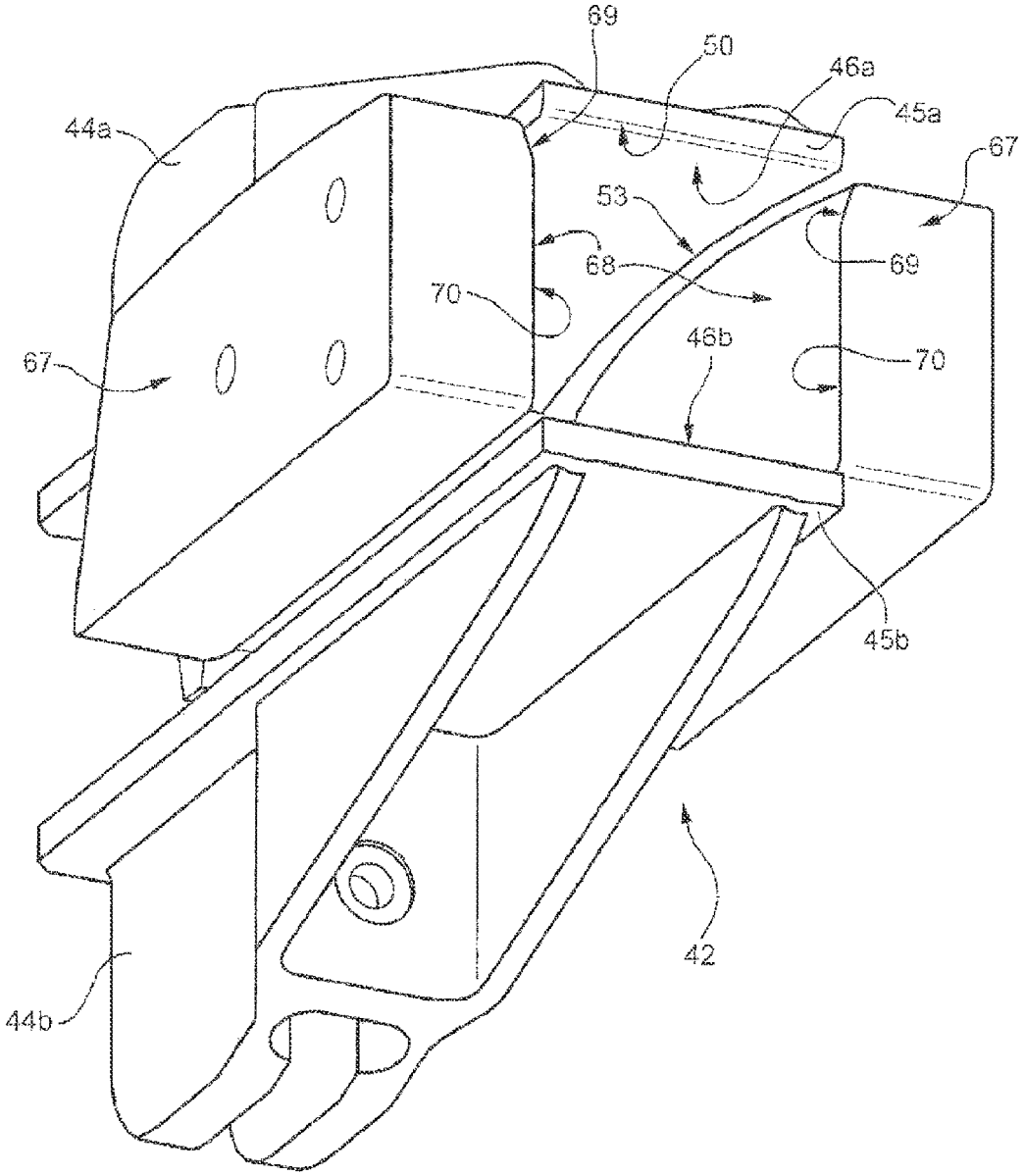
FIG. 3 is a perspective view of the first assembly of FIG. 1 in a second angular position and of a second assembly of the folding unit of FIG. 1.

When pressure devices 66, 67 are in respective work position, each pressure device 67 extends between surfaces 46*a*, 46*b* of the conveying device 42 which is arranged at station $B_5$ (FIG. 3).

Surfaces 68 are advantageously convex, so as to form concave walls 104, 105 of the finished package 2.

In detail, each surface 68 comprises a first convex region 69 adjacent to surface 46*a* and a second convex region 70 adjacent to surface 46*b*, when pressure devices 66, 67 are in respective work position.

The curvature of surface 69 is higher than the curvature of surface 70.

Operation of unit 1 will be described with reference to one pack 3, and as of the instant in which a push member 84 of conveyor 80 feeds a corresponding conveying device 42 arranged at station $B_1$ with such a pack 3.

More specifically, member 45*b* of conveying device 42 is parted slightly, by rotation about axis D, from member 45*a* at station $B_1$, to permit insertion of pack 3.

As soon as pack 3 is inserted inside relative conveying device 42, members 45*a*, 45*b* are brought together so that surfaces 46*a*, 46*b* rest on respective first and second walls 10.

More specifically, pack 3 is housed inside conveying device 42 with portion 7 facing axis C and cooperating with surface 49 of element 48, and with portion 6 arranged on the opposite side of axis C. In this way, surface 49 of element 48 folds portion 7 so as to form top wall 101 of pack 3.

Pack 3 is moved along forming path B by conveyor 40 rotating clockwise, as seen in FIG. 1, about axis C.

As conveying device 42 moves from station $B_1$ to folding device 55, the first pair of rails 22 cooperates with lateral ends of tab 13 and with lateral ends of tab 14.

As conveying device 42 reaches station $B_3$, folding device 55 reaches the work position, in which it compresses the intermediate portion of wall 12, between flaps 15, of portion 6 towards axis C.

The above compression produces a slight translation of pack 3 towards axis C, so that flaps 15 rotate about respective fold lines 17 into a position parallel to axis A, and flaps 16 rotate about respective fold lines 18 into a position sloping roughly ten degrees with respect to the plane of top wall 100, after that folding of package 2 has been completed.

Afterwards, folding device 55 is moved towards its rest position.

Conveyor 40 then moves pack 3 along path B from folding device 55 to heating device 60.

In the same time, the second pair of rails 22 folds flaps 15, 16 towards axis A so that they, by the time they reach heating device 60, slope roughly forty-five degrees relative to walls 12, 11 respectively.

At station $B_4$, conveyor 40 stops, and heating device 60 blows hot air onto flaps 15, 16 of pack 3, preparatory to heat sealing the flaps to walls 12, 11.

Further rotation of conveyor 40 feeds pack 3 along of path B away from heating device 60 and towards folding device 65.

As conveying device 42 advances pack 3, the third pair of rails 22 folds flaps 15 towards wall 12 of portion 6 until it forms an angle of roughly ten degrees with walls 12, and fold flaps 16 towards walls 11 until flap 16 forms an angle of roughly ten degrees with relative wall 11.

As it reaches station $B_5$, conveyor 40 stops, and pressure devices 66, 67 of folding device 65 are moved into their respective work positions. In the work position, pressure device 66 presses the heated flaps 16 onto walls 12 of pack 3, and surfaces 68 of pressure device 67 press the heated flaps 16 onto walls 11 of pack 3 to complete package 2.

Due to the fact that it is concave, surface 46*a* of conveying device 42 controls the shape of first wall 10 with which it cooperates as packs 3 travels along path B and, therefore, during the whole forming process of package 2.

As a result, front wall 102 of package 2 is formed as convex.

In the very same way, surface 46*b* of conveying device 42 controls the shape of wall 10 with which it cooperates as packs 3 travels along path B and, therefore, during the whole forming process of package 2.

As a result, rear wall 103 of package 2 is formed as flat.

Furthermore, surfaces 68 are convex and control the shape of flaps 16 and walls 11 during the final folding of pack 3. Therefore, walls 104, 105 of folded package 2 are formed as concave.

The pressure applied as described above seals flaps 15, 16 to walls 12, 11 so as to complete the formation of bottom wall 101, lateral walls 104, 105 and top wall 100 of package 2.

As conveying device 42 reaches station $B_2$, member 45*b* is parted slightly relative to axis D from member 45*a* to withdraw surfaces 46*a*, 46*b* slightly from relative walls 10.

Folded package 2 is then released to output conveyor 90.

The advantages of unit 1 according to the present invention will be clear from the foregoing description.

In particular, concave surfaces 46*a* of conveying devices 42 control the shape of first walls 10 with which they cooperate as relative packs 3 are folded so as to form corresponding packages 2. As a result, front walls 102 of packages 2 may be formed as having a convex shape.

Furthermore, edges 52, 53 extend on the opposite side of plane P relative to surface 46*b* and control the shape of crease lines 107, as packs 3 are folded to form corresponding packages 2.

Accordingly, the desired shape of crease lines 107 of packages 2 may be obtained.

Finally, convex surfaces 67 control the shape of relative walls 11 of packs 3 with which they cooperate as these packs 3 are folded so as to form corresponding packages 2. As a result, lateral walls 104, 105 of packages 2 may be formed as having a concave shape.

Clearly, changes may be made to unit 1 as described and illustrated herein without, however, departing from the scope defined in the accompanying Claims.

In particular, unit 1 could be used for forming packages 2 having rear walls 103 which bulge on the opposite side of corresponding front walls 102. In this case, surfaces 46*b* of conveying devices 42 would be concave.

The invention claimed is:

1. A folding unit for forming sealed packages of pourable food products, comprising:

at least one conveying device for feeding along a forming path a respective pack which includes at least one portion to be folded to form a finished package;

at least one folding device interacting, in use, with said respective pack along said forming path and adapted to fold said at least one portion;

said conveying device comprising first and second surfaces configured to cooperate respectively with a front wall and a rear wall of said respective pack to be folded, the front and rear walls of said respective pack facing away from one another; and wherein said first surface is at least partially concavely curved.

2. The folding unit of claim 1, wherein said conveying device is movable along a closed path which extends around an axis;

said conveying device comprising:

first and second edges, said first surface being bound between said first and second edges, said axis being closer to said second edge than to said first edge;

third and fourth edges which extend between said first and second edges; and said third and fourth edges extending such that a theoretical plane defined by said first and second edges is located between said second surface and said third and fourth edges.

3. The folding unit of claim 2, wherein said third and fourth edges extend at first at increasing distances and then at decreasing distances from said theoretical plane, proceeding from said first edge to said second edge.

4. The folding unit of claim 2, wherein said third and fourth edges converge towards each other and diverge from each other, proceeding from said first edge to said second edge.

5. The folding unit of claim 1, wherein said second surface is planar.

6. The folding unit of claim 1, comprising a heating device configured to heat, in use, unfolded flaps of said respective pack;

said folding device being arranged downstream from said heating device along said path and comprising a pair of pressure devices;

said pressure devices comprising third surfaces, said pressure devices being movable between an operative position in which respective third surfaces press respective flaps of said respective pack onto respective lateral walls of said respective pack to be folded, and a rest position in which said respective third surfaces are detached from said respective pack; and said third surfaces being convexly curved.

7. The folding unit of claim 1, comprising:

a first conveyor; and a second conveyor provided with a plurality of said conveying devices and fed, in use, by said first conveyor with said respective pack at an inlet station of said path;

said first conveyor comprising:

a closed-loop belt;

a plurality of push members fitted to said belt and adapted to travel along an endless path, said push members being arranged at fixed distances apart from one another and adapted to interact with said respective pack to move said respective pack towards said second conveyor as said push members travel along said endless path while said respective pack rests against a respective one of said push members; and a pair of fixed rails which cooperate with said respective pack, so as to ensure that said respective pack remains detached from said belt.

8. A folding unit for forming sealed packages of pourable food products, comprising:

at least one conveying device for feeding along a forming path a respective pack which includes at least one portion to be folded to form a finished package;

said conveying device comprising a first surface and a second surface configured to cooperate respectively with a front wall and a rear wall of said respective pack to be folded, the front and rear walls of said respective pack facing away from one another;

a heating device configured to heat, in use, unfolded flaps of said respective pack;

a folding device arranged downstream from said heating device along said path, comprising a pair of pressure devices and adapted to perform a folding operation onto said respective pack travelling, in use, along said path;

said pressure devices comprising third surfaces, said pressure devices being movable between an operative position in which respective third surfaces press respective flaps of said respective pack onto respective lateral walls of said respective pack to be folded, and a rest position in which said respective third surfaces are detached from said respective pack; and wherein said first surface is at least partially concavely curved and said third surfaces are convexly curved.

* * * * *